US006019595A

United States Patent [19]

Wulfert et al.

[11] Patent Number: 6,019,595

[45] Date of Patent: Feb. 1, 2000

[54] BURNER

[75] Inventors: Holger Wulfert, Duesseldorf; Friedrich Schmaus, Balve, both of Germany

[73] Assignee: Loesche GmbH, Germany

[21] Appl. No.: 09/214,418

[22] PCT Filed: Jul. 4, 1997

[86] PCT No.: PCT/EP97/03545

§ 371 Date: Jan. 5, 1999

§ 102(e) Date: Jan. 5, 1999

[87] PCT Pub. No.: WO98/01707

PCT Pub. Date: Jan. 15, 1998

[30] Foreign Application Priority Data

Jul. 5, 1996 [DE] Germany ..... 196 27 203

[51] Int. Cl.[7] ..... F23C 5/08

[52] U.S. Cl. ..... 431/181; 431/187; 431/284; 431/353; 239/422; 239/424.5

[58] Field of Search ..... 431/278, 181, 431/187, 188, 284, 285, 353, 10; 239/423, 424, 424.5, 405, 419, 427, 422

[56] References Cited

U.S. PATENT DOCUMENTS

| | | | |
|---|---|---|---|
| 3,706,520 | 12/1972 | Grimm et al. | 239/424.5 |
| 4,169,700 | 10/1979 | Yoshioka et al. . | |
| 4,383,820 | 5/1983 | Camacho | 431/8 |
| 4,402,666 | 9/1983 | Glomm et al. | 431/187 |
| 4,602,571 | 7/1986 | Chadshay | 431/188 |
| 5,044,931 | 9/1991 | Van Eerden et al. | 431/284 |
| 5,267,850 | 12/1993 | Kobayashi et al. . | |
| 5,308,239 | 5/1994 | Bazarian et al. | 431/187 |

FOREIGN PATENT DOCUMENTS

| | | |
|---|---|---|
| 0 486 285 A2 | 5/1992 | European Pat. Off. . |
| 42 08 951 C2 | 9/1993 | Germany . |

*Primary Examiner*—James C. Yeung

*Attorney, Agent, or Firm*—Evenson, McKeown, Edwards & Lenahan, P.L.L.C.

[57] ABSTRACT

A burner for mixing and burning at least two combustion media, particularly combustion air and a poor gas as a combustible gas. The burner comprises several burner nozzles. Each burner nozzle comprises at least three mutually coaxially arranged tubes. The tubes are radially spaced from one another so as to form annular clearance ducts, through which the combustion media can be passed into a combustion chamber. The arrangement according to the invention permits a good mixing and burning of several gaseous combustion media.

10 Claims, 2 Drawing Sheets

BURNER

BACKGROUND AND SUMMARY OF THE INVENTION

The invention relates to a burner for the mixing and combustion of at least two combustion media.

In the case of such burners use can more particularly be made of combustion air and a poor or lean gas as the combustible gas. The burner comprises several burner nozzles, in each case a tube, which for the supply of a combustion medium extends to a combustion chamber and an inflow device for the other combustion medium can be provided at the combustion chamber-side end of the tube.

Such a burner is known from U.S. Pat. No. 5,267,850, which describes a burner system and a combustion process for high temperature applications. At one burner nozzle of the burner, a central high speed fuel flow is produced, which is annularly surrounded by a low speed flow.

Another burner used in connection with the hot gas producer is known from DE 42 08 951 C2. For the supply of one combustion medium the known burner has tubes, whose free ends are surrounded by the outlet nozzles for the inflow of a second combustion medium. This known arrangement leads to a very good complete combustion result in the case of a short burner flame. However, it is desirable to further improve the known burner with respect to the degree of complete combustion and the flame length.

The object of the invention is to provide a burner which, in the case of a short flame, also ensures a very complete combustion of combustion media even with very low calorific values.

According to the invention, this object is achieved by a burner nozzle provided with at least three mutually coaxially arranged tubes, namely an inner, core tube, an outer tube and at least one intermediate tube positioned between them. The tubes are radially spaced for forming annular clearance ducts, through which combustion media can be passed into the combustion chamber.

With this burner nozzle construction which, apart from the central core tube opening, has at least two annular clearance openings, the flame at the burner nozzle can be adjusted in virtually any desired manner. Thus, in accordance with the number of openings, it is possible to use more than two combustion media with different pressures. The at least three burner nozzle openings arranged concentrically to one another also ensure an intense mixing of the combustion media and consequently a particularly large combustion surface. This leads to a short flame and a very good degree of complete combustion. The stepped, axial arrangement of the tubes consequently ensures a mixing of the gases displaced as regards time and place in an optimum manner.

An advantage of the burner according to the invention is the possibility of operating it with so-called lean or poor gas, i.e. a combustible gas with a relatively low caloric value. With the hitherto known burners it was possible to achieve a spontaneous combustion with poor gases having a caloric value of at least approximately 2500 kJ/m$^3$ (standard state). Tests have shown that with the burner according to the invention, even when using poor gases with a caloric value of approximately 1900 kJ/m$^3$ (standard state), there is an independent combustion process. Thus, there is no need for additional burners with a high-grade combustible gas.

A particularly good combustion result is achieved through the tubes extending to a varying extent into the combustion chamber. Thus, the burner nozzle tubes have a stepped arrangement. The burner nozzle openings are mutually displaced in the axial direction of the tubes. This leads to a mixing of the different gaseous combustion media in place and time-displaced manner, which leads to a particularly good mixing of the media.

It is advantageous for the outer tube to extend further into the combustion chamber than the intermediate tube. Thus, the outer tube forms a lateral boundary of the burner nozzle, so that the influence of neighbouring burner nozzles on the mixing process is substantially avoided.

According to an advantageous embodiment, the core tube extends further into the combustion chamber than the intermediate tube. Thus, there is initially a mixing of the combustion media flowing out of the annular clearance ducts. Following mixing in the lateral areas of the burner nozzle, an additional turbulence and consequently a particularly large contact surface is obtained between the combustion media through the flow out of the core tube.

In order in this arrangement to ensure a good focussing or bundling of the flame of the individual burner nozzles, the outer tube extends further into the combustion chamber than the core tube.

According to a further development of the burner according to the invention a compartment is provided for each combustion medium and is line-connected to each burner nozzle. The individual, separate compartments in their turn have inlets, through which the combustion medium flows into the associated compartment, it being possible in simple manner to adjust in the compartments the particular pressure of the combustion medium.

This embodiment is further developed in that three compartments are provided, whereof the first compartment is connected to the core tube, the second compartment to the annular clearance duct formed by the core tube and the intermediate tube and the third compartment to the annular clearance duct formed by the intermediate tube and the outer tube. Thus, in this further development, a first combustion medium flows via the first compartment and the core tube into the combustion chamber. The second combustion medium flows via the second compartment and the associated annular clearance duct into the combustion chamber, whilst the third combustion medium is passed through the third compartment and the other annular clearance duct. As a result of this separate supply it is possible to achieve a good mixing in the case of three different combustion media.

According to an alternative embodiment, there are two compartments, whereof one is connected to the core tube and an annular clearance duct. The other compartment is then correspondingly connected with the one or more remaining annular clearance ducts. Thus, e.g. two combustion media can flow through several separate burner nozzle openings into the combustion chamber, which leads to a high and desired degree of turbulence.

It is also advantageous for certain applications for the burner nozzle to have four tubes. Then, besides the core tube opening, there are in all three annular clearance openings. Thus, in this embodiment, four combustion media can separately be supplied. When using less combustion media individual combustion media can be supplied via several burner nozzle openings in order to achieve a good mixing. If special applications justify the constructional expenditure, of course it is possible to provide burner nozzles with five or more tubes.

To improve the turbulence of the combustion media, it is advantageous to provide at the combustion chamber-side end of the burner nozzle whirl or swirl devices. The whirl devices can be substantially radially directed nozzles. A particularly simple and effective whirl device e.g. for the core tube, is provided by the construction of radially directed bores in the core tube wall, the free end of the core tube being closed or sealed by a plate.

In order to ensure a problem-free ignition, the burner according to the invention is so further developed that a starting burner is provided and around it are arranged the burner nozzles. The starting burner is supplied with separate combustion media, particularly a high-grade combustible gas. Following a certain start-up time, the starting burner can be switched off again.

A particular advantage of the invention is that one of the combustion media can be a sulphurous gas, particularly hydrogen sulphide. Up to now, such gases have had to be disposed of in an expensive manner, but can now be usefully thermally burned and recycled using the burner according to the invention.

BRIEF DESCRIPTION OF THE DRAWINGS

The invention is described in greater detail hereinafter relative to an embodiment and the attached drawings, wherein show.

DETAILED DESCRIPTION OF THE DRAWINGS

Figure 1:
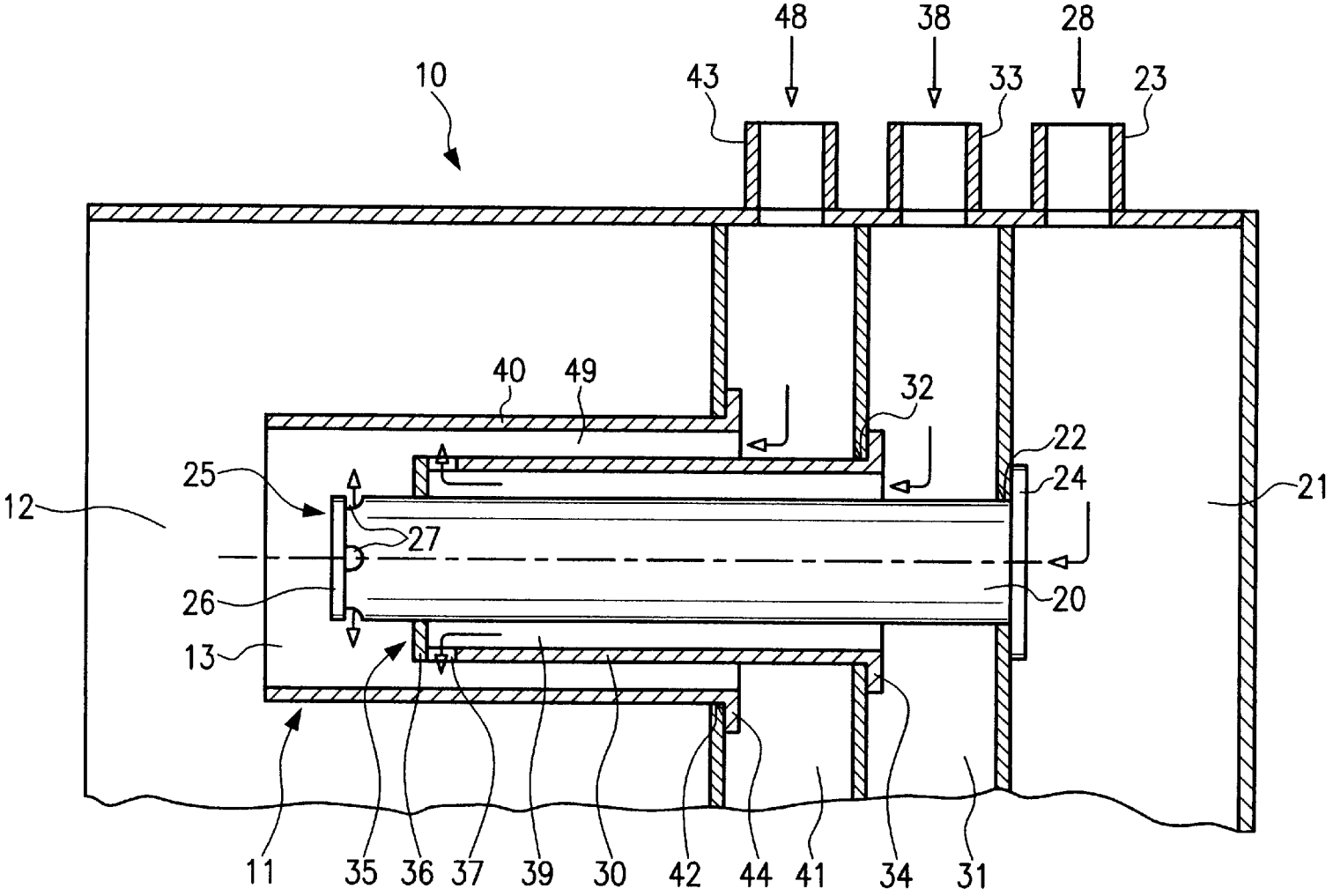
FIG. 1 A diagrammatic part cross-sectional view through a burner according to the invention.

The part cross-sectional view of FIG. 1 shows an inventive burner 10 with a burner nozzle 11 constructed from three coaxially arranged tubes. The inner tube is called the core tube 20 and it is surrounded by an intermediate tube 30 and an external, outer tube 40.

The core tube 20 is connected by means of a flange 24 to the wall of a first compartment 21, so that a first combustion medium 28 can flow via an inlet 23 through the first compartment 21 into the core tube 20. The flange 24 is fixed by a suitable joint, e.g. a weld or a gas-tight screw connection, to the wall of the first compartment 21 around a through opening 22.

Starting from the first compartment 21, the core tube 20 extends through a second compartment 31 and a third compartment 41 in the direction of a combustion chamber 12, in which the combustion process takes place.

To the second compartment 31 about a through opening 32 is fixed a second or so-called intermediate tube 30 by means of a flange 34. The internal diameter of the intermediate tube 30, which extends coaxially in the direction of the combustion chamber 12, is larger than the external diameter of the core tube 20, so that a first annular clearance duct 39 is formed between the core tube 20 and the intermediate tube 30. Through said first annular clearance duct 39 can flow a second combustion medium 38 via an inlet 33 and the second compartment 31 to the free end of the burner nozzle 11.

As from the third compartment 41, the core tube 20 and intermediate tube 30 are surrounded by an outer tube 40, which extends coaxially to the two other tubes in the direction of the combustion chamber 12. In the same way as for the two other tubes, the outer tube 40 is fixed around a through opening 42 on a combustion chamber-side wall of the third compartment, to the latter by means of a flange 44. The internal diameter of the outer tube 40 is again larger than the external diameter of the intermediate tube 30, so that a second annular clearance duct 49 is formed. Through said annular clearance duct 49 can flow a third combustion medium 48 via an inlet 43 and the third compartment 41 into the combustion chamber 12.

In the case of the represented embodiment of the inventive burner with a three-compartment arrangement normally through the core tube 20 and the first annular clearance duct is passed one or two combustible gases, whilst the second annular clearance duct 49 is used for the combustion air supply. In particular, through the core tube 20 and first annular clearance duct 39 can be passed acid-containing gases, e.g. hydrogen sulphide-containing gases with the same or different concentrations.

In order to bring about an optimum mixing of the different combustion media 28, 38, 48 in a mixing zone 13 at the combustion chamber-side end of the burner nozzle 11 a number of measures are provided. Firstly the outer tube 40 extends further into the combustion chamber 12 than the core tube 20, which in turn extends further into the combustion chamber 12 than the intermediate tube 30. In the case of this stepped arrangement, firstly the second combustion medium 38, which passes out of the opening of the first annular clearance duct 39, is mixed with the third combustion medium 48, which flows out of the exit opening of the second annular clearance duct 49. Only following the mixing of the second and third combustion media 38, 48, does the first combustion medium 28 flow out of the core tube 20 into the mixing zone 13, so that as a result there is a further turbulence displaced as regards time and place with respect to the first mixing process. This leads to a particularly good mixing of the combustion media 28, 38, 48, leading to a good degree of complete combustion in the case of a short flame. The outer tube 40 which passes furthest into the combustion chamber 12 serves as a lateral boundary of the mixing zone 13, which ensures a locally defined zone with strong turbulence.

As a further measure for increasing turbulence between the individual combustion media 28, 38, 48, whirl devices 25, 35 are provided on the core tube 20 and intermediate tube 30. Each of the whirl devices 25, 35 comprises a shut-off or sealing plate 26, 36, which is engaged on the combustion chamber-side end of the core tube 20 or intermediate tube 30. By means of radially directed bores or slots 27, 37, the particular combustion medium 28, 38 flows radially into the mixing zone 13.

A particularly strong turbulence results from superimposing with the axially directed flow from the second annular clearance duct 49.

Figure 2:
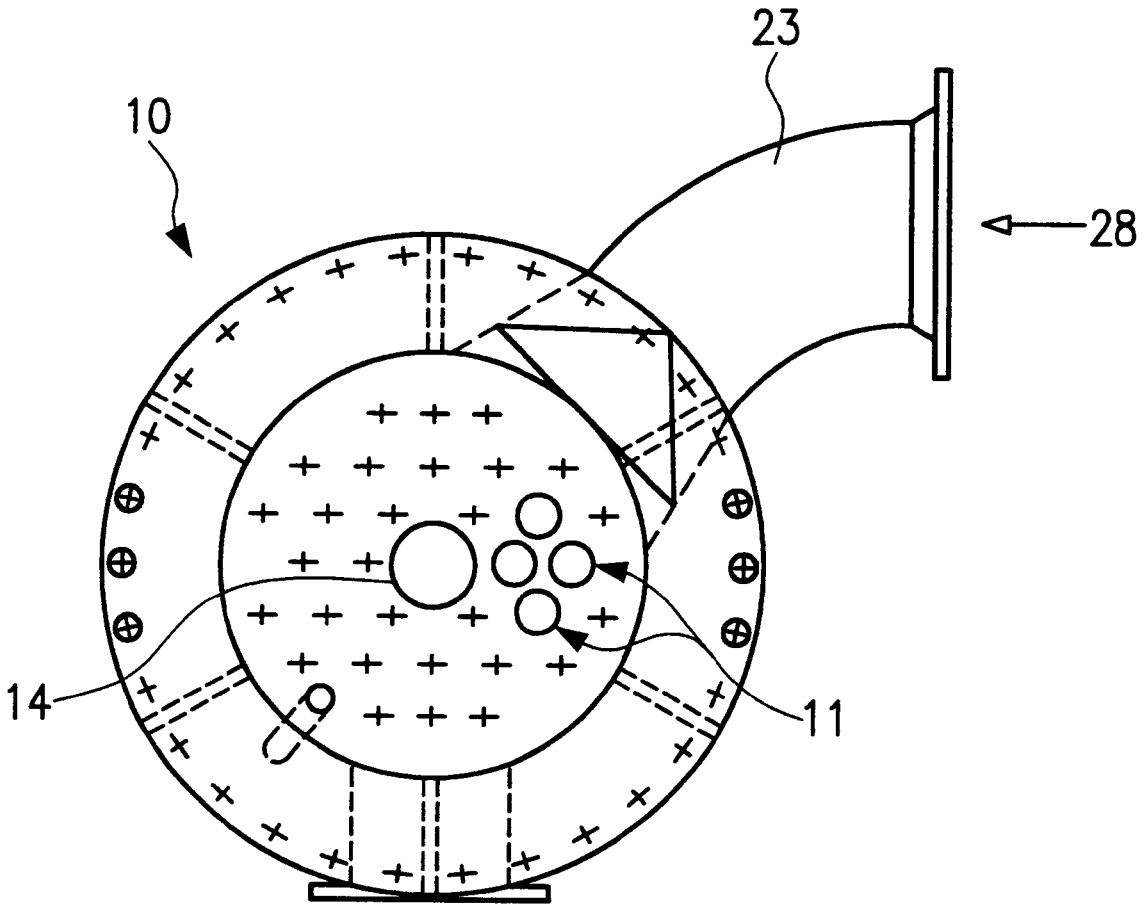
FIG. 2 A diagrammatic front view of the burner according to the invention, the scale of reproduction being smaller than that of FIG. 1.

FIG. 2 is a smaller scale front view of the burner 10 according to the invention. It can be seen that there is a centrally positioned starting burner 14, around which are provided several burner nozzles 11 and so as not to overburden the drawing they are in part only represented by their centre points. In this case only one connecting piece of the inlet 23 is shown, through which the first combustion medium 28 flows into the first compartment 21. Of course there are also second and third inlet connecting pieces.

The burner according to the invention, which has a plurality of individual burner nozzles 11, consequently creates a large surface for combustion purposes. It is therefore possible to burn with said burner hydrogen sulphide-containing or acid-containing gases, the latter are preferably very intensely mixed with combustion air flowing at right angles thereto. With respect to a requisite exit temperature at the burner outlet and an inadequate acid-containing gas content, the burner can be set so that in such a case the starting burner is immediately put into operation again in order to obtain the requisite burner exit temperature.

We claim:

1. A burner for mixing and burning at least two combustion media, comprising:

several burner nozzles which have tubes for the supply of the combustion media to a combustion chamber, each of said burner nozzles having at least three tubes being mutually coaxially arranged and providing a core tube, an outer tube and at least one intermediate tube, said tubes being radially spaced and forming annular clearance ducts through which the combustion media can be passed into the combustion chamber, wherein said outer tube projecting further into said combustion chamber than the other tubes and forming a mixing zone, said core tube and intermediate tube extending to a differing extent into said mixing zone, said core tube and intermediate tube being sealed at their combustion chamber-side end by in each case one sealing plate and wherein said core tube and intermediate tube being formed openings, through which flow the combustion media in a substantially radial direction into said mixing zone.

2. Burner according to claim 1, wherein said core tube extending further into said combustion chamber than said intermediate tube.

3. Burner according to claim 1, wherein for each of said combustion media is provided a compartment and each of said compartments being line-connected to each burner nozzle.

4. Burner according to claim 3, wherein three of said compartments being provided, whereof a first of said compartments being connected to said core tube, a second of said compartments being connected to an annular clearance duct, formed by said corer tube and said intermediate tube, and a third of said compartments being connected to an annular clearance duct formed by said intermediate tube and said outer tube.

5. Burner according to claim 3, wherein two of said compartments being provided, whereof one of said compartments being connected to said core tube and one of said annular clearance ducts.

6. Burner according to claim 1, wherein said burner nozzles having four tubes.

7. Burner according to claim 1, wherein a starting burner is provided and said burner nozzles being arranged around said starting burner.

8. Burner according to claim 7, wherein said two combustion media being combustion air and a poor gas as a combustible gas.

9. Burner according to claim 8, wherein said combustible gas being a hydrogen sulphide-containing gas.

10. Burner according to claim 1, wherein said openings being slots which are made at said combustion chamber-side end of said core tube and said intermediate tube.

* * * * *